US005692364A

United States Patent [19]

Staniszewski

[11] Patent Number: 5,692,364

[45] Date of Patent: Dec. 2, 1997

[54] ENVELOPE STUFFER

[76] Inventor: Tadeusz Staniszewski, 33 Karen Pl., Budd Lake, N.J. 07828

[21] Appl. No.: 730,076

[22] Filed: Oct. 15, 1996

[51] Int. Cl.[6] ..... B65B 43/26; B65B 39/06

[52] U.S. Cl. ..... 53/569; 53/381.7

[58] Field of Search ..... 53/460, 569, 284.3, 53/381.5, 381.7

[56] References Cited

U.S. PATENT DOCUMENTS

| | | | |
|---|---|---|---|
| 2,839,880 | 6/1958 | Boughton | 53/569 |
| 4,471,598 | 9/1984 | Martinez Sanz | 53/284.3 |
| 4,852,334 | 8/1989 | Auerbach | 53/284.3 X |
| 4,903,456 | 2/1990 | Meur | 53/569 X |
| 5,168,689 | 12/1992 | Macelis | 53/569 |
| 5,191,751 | 3/1993 | Marzullo et al. | 53/569 |
| 5,630,312 | 5/1997 | Ballard et al. | 53/569 |

*Primary Examiner*—Horace M. Culver
*Attorney, Agent, or Firm*—Bernard J. Murphy

[57] ABSTRACT

A first roller and its companion plate comprise structures for moving an envelope into a framework, and a second roller and its companion plate comprise structure for moving a document into the envelope, while the envelope is held open for insertion of the document. Switching devices detect the entry of the envelope and document and cause a gearing arrangement to rotate the rollers, to move the envelope to a document-receiving disposition within the framework, and to move the document into the envelope.

11 Claims, 6 Drawing Sheets

ENVELOPE STUFFER

This invention pertains to devices operative for stuffing documents, papers and the like into envelopes, and in particular to an envelope stuffer of novel construction and operation which has a minimum of moving parts and, as a consequence thereof, is inexpensive of manufacture and maintenance.

It is an object of this invention to disclose the novel envelope stuffer, and to cite its efficient construction and features of operation.

Specifically, it is an object of this invention to set forth an envelope stuffer comprising a framework; said framework having a horizontal platform, and a pair of uprights coupled to, and adjacent ends of said platform; a pair of rollers, journalled in said uprights, in parallel, and spaced apart from each other; a pair of plates pivotably mounted to said uprights; one of said plates having planar side which parallels one of said rollers and comprising a companion plate for said one roller; the other of said plates also having a planar side which parallels the other of said rollers and comprising a companion plate for said other roller; biasing means, coupled to said uprights and to said plates, for urging said side of said one plate into fast engagement with said one roller, and for urging said side of said other plate into fast engagement with said other roller; powered drive means, coupled to said rollers, operative for rotating said rollers; first switching means, coupled to said drive means having an operating sensor disposed for contacting engagement thereof by an edge of an envelope inserted between one of said rollers and its companion plate, for (a) causing said drive means to operate, to rotate said one roller, and to propel such envelope between said one roller and its companion plate, and (b) halting operation of said drive means upon such envelope having moved beyond sensor engagement to a given positioning in said framework; projections, extending inwardly of said framework, cooperative with said one roller and its companion plate, for holding the flap of such envelope, upon such envelope having moved to said given positioning; and second switching means, also coupled to said drive means, having an operating sensor disposed for contacting engagement thereof by an edge of a document inserted between the other of said rollers and its companion plate, for (a) causing said drive means to operate, to rotate said other roller, and to propel such document (1) between said other roller and its companion plate, (2) beneath and slidably along an underside of the envelope flap, and (3) into such envelope, and (b) halting operation of said drive means upon such document having moved beyond sensor engagement.

Further objects of this invention, as well as the novel features thereof, will become apparent by reference to the following description, taken in conjunction with the accompanying figures, in which.

Figure 2:
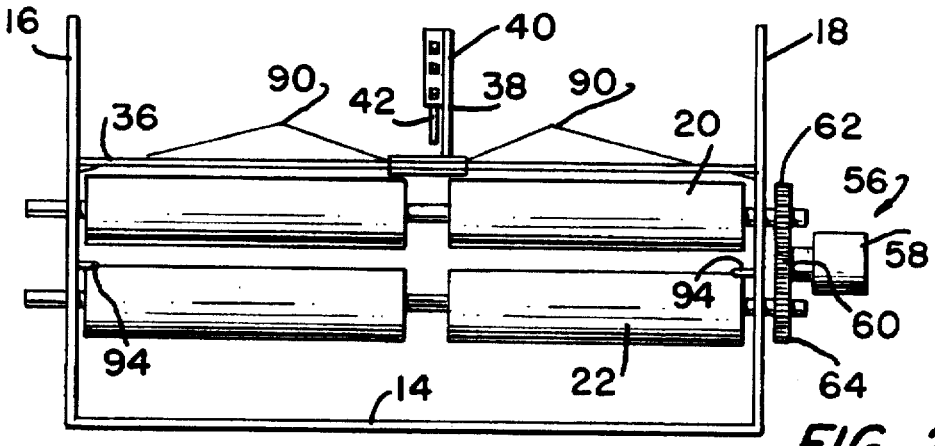
FIG. 2 is a front elevational view thereof.
Figure 4:
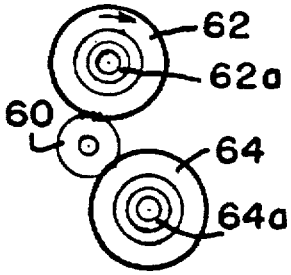
FIG. 4 is a view taken along section 4—4 of FIG. 3.
Figure 5:
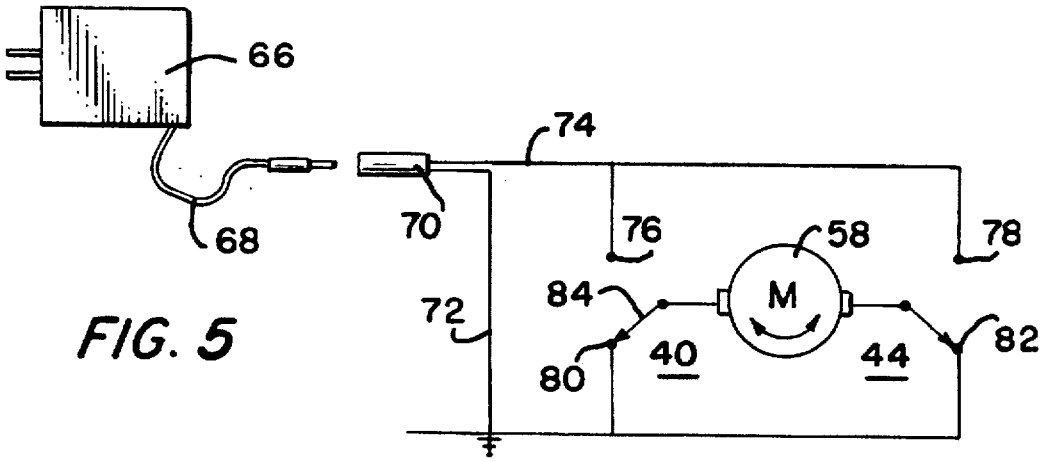
FIG. 5 is a schematic diagram of the power, motor and switching circuitry for the gear train.
Figure 6:
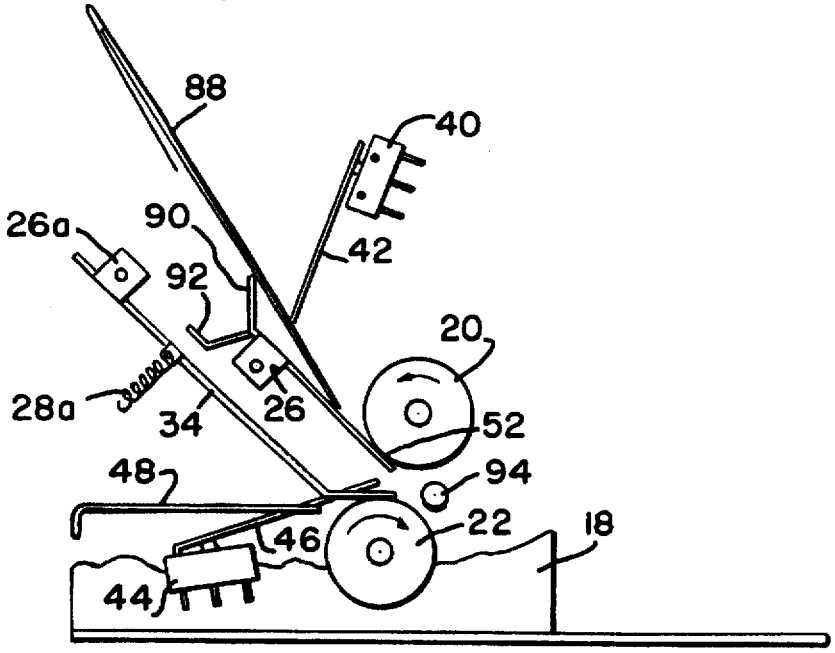
FIG. 6 is a side elevational view, like that of FIG. 1, albeit with most of the framework structure omitted for clarity of understanding, and showing an envelope actuating the first switch.
Figure 7:
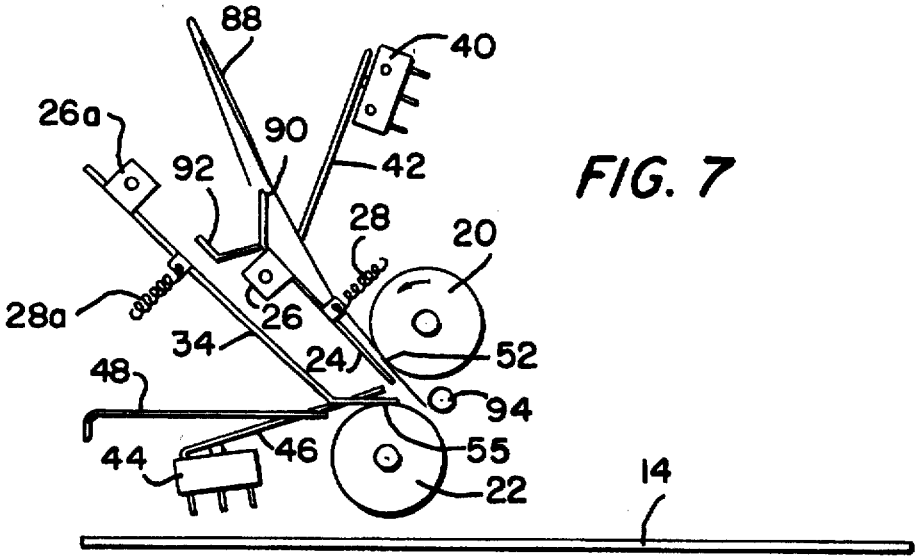
Figure 8:
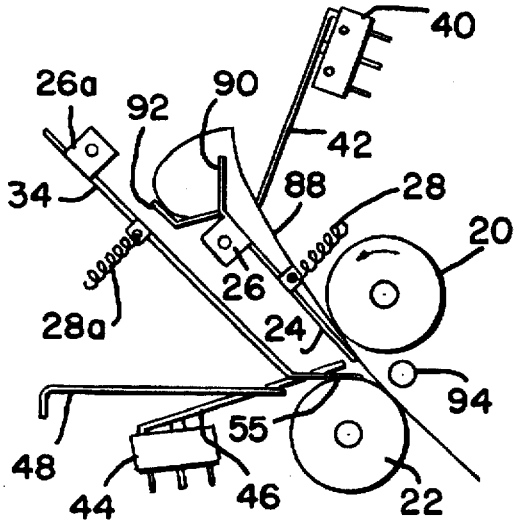
Figure 9:
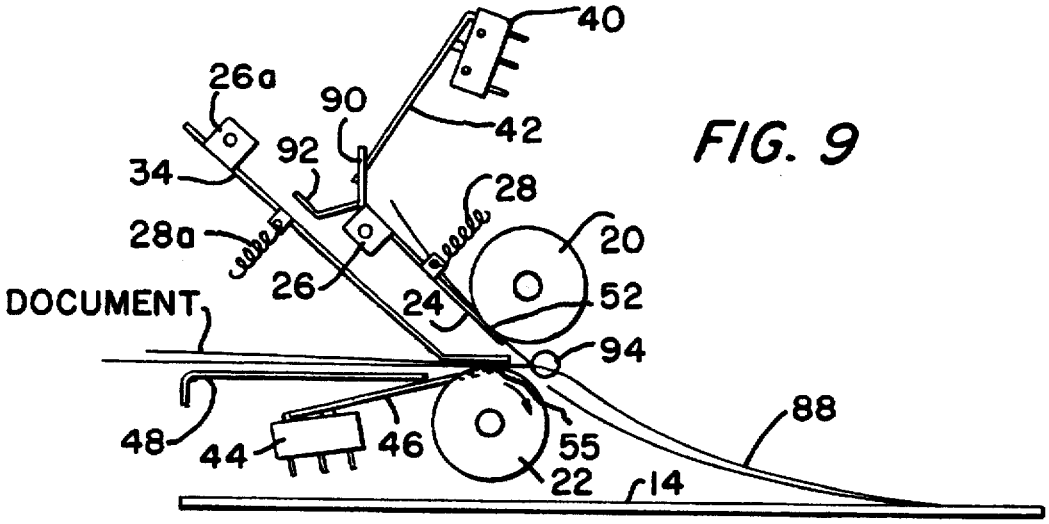
Figure 10:
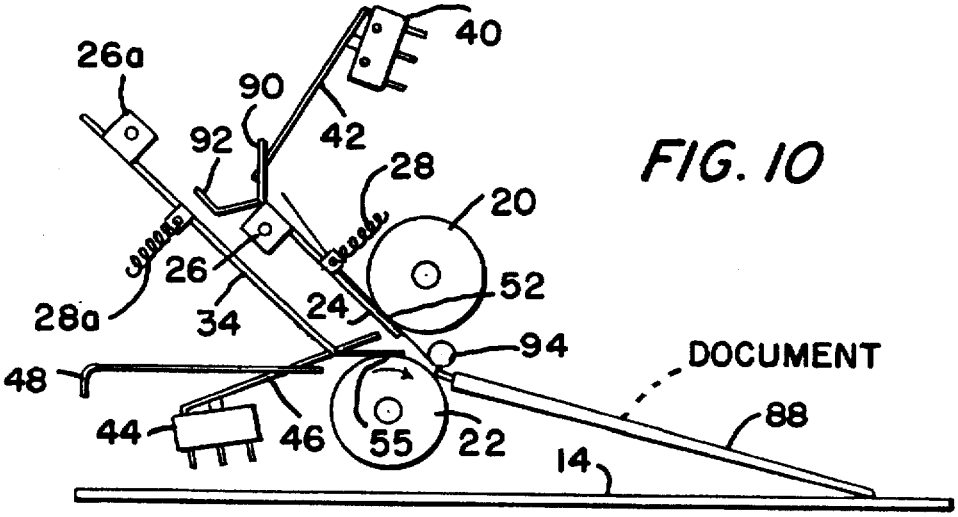
Figure 11:
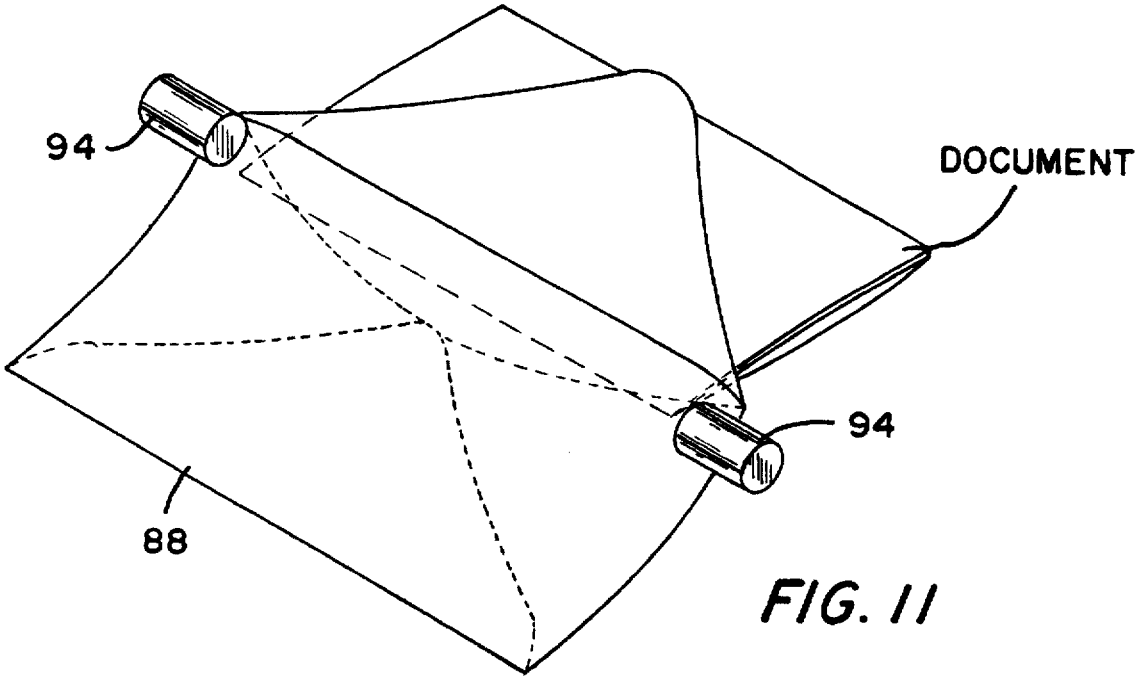
Figure 12:
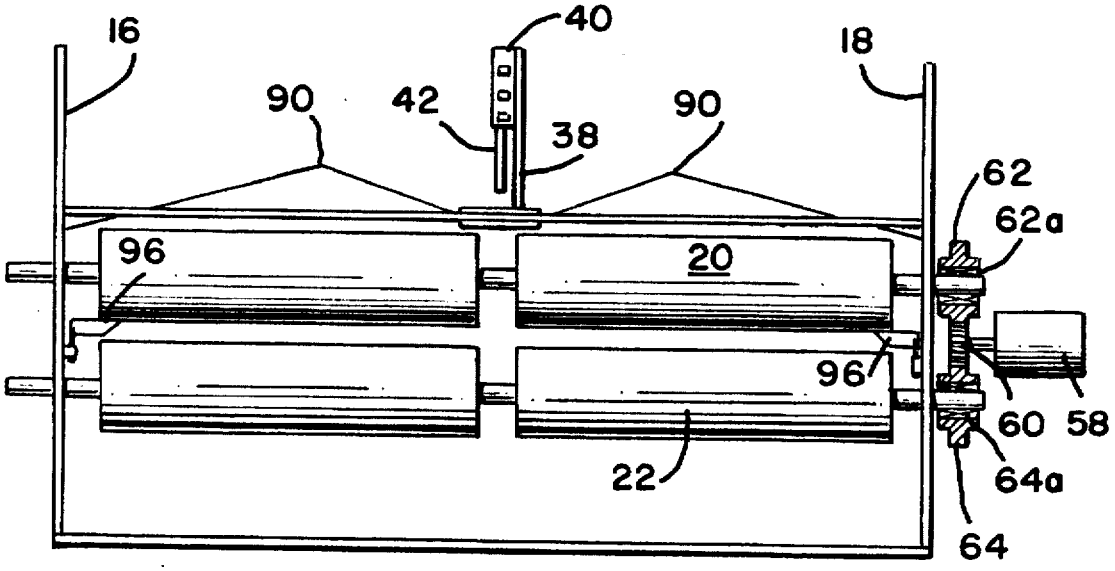
Figure 13:
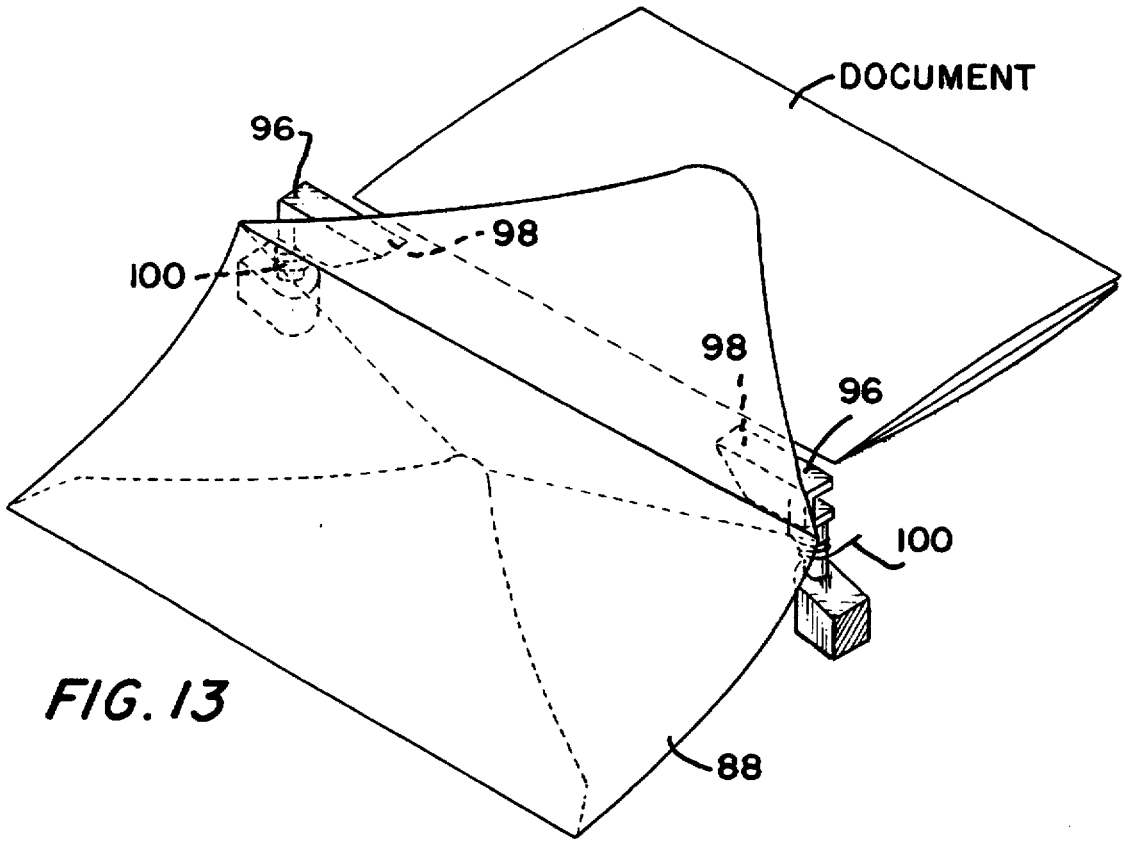
Figure 14:
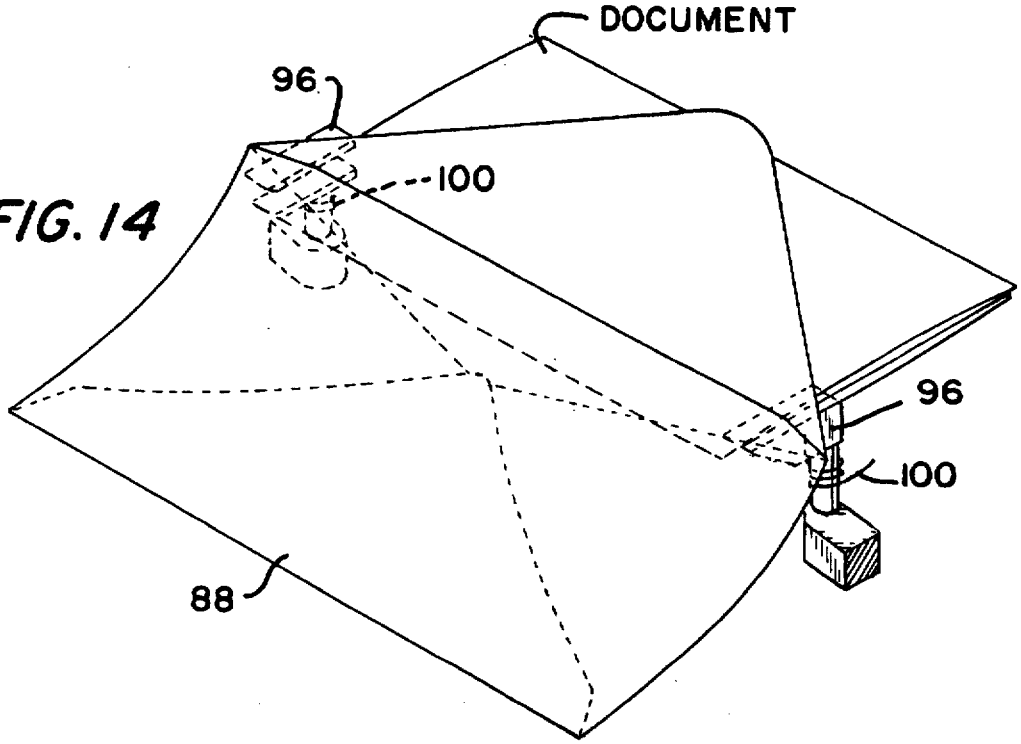
Figure 15:
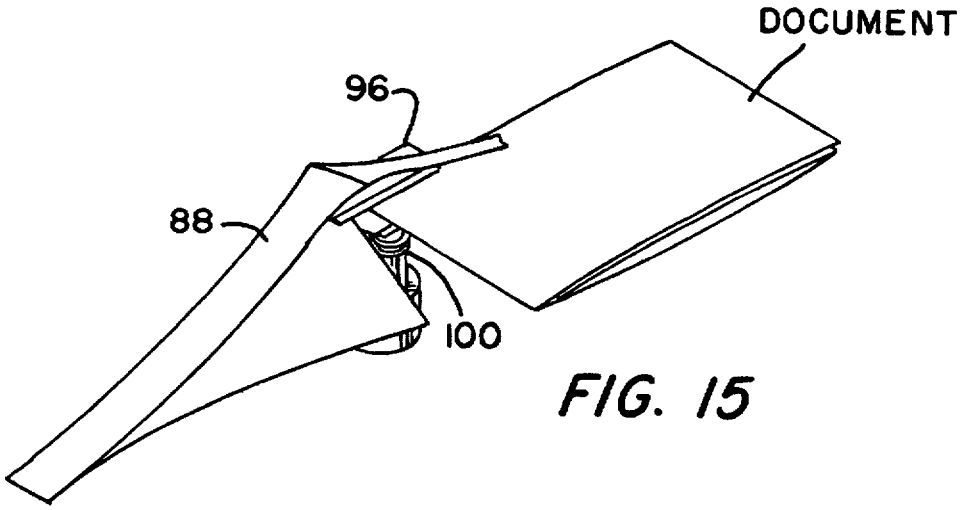
Figure 16:
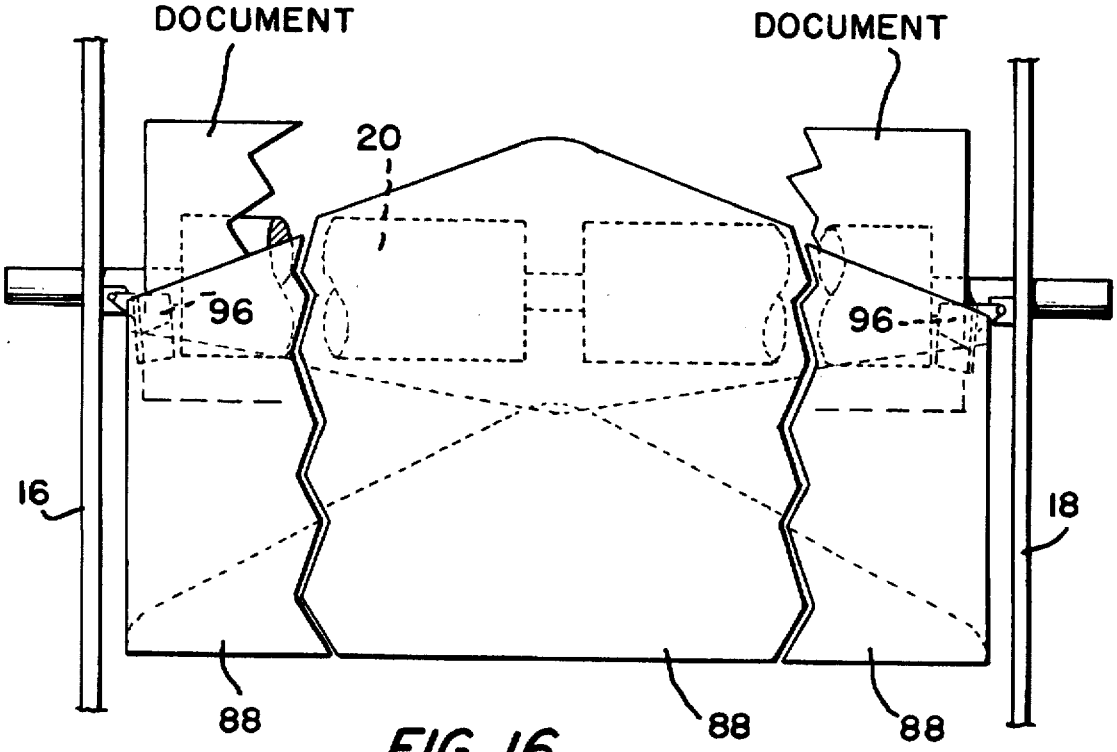

FIGS. 7 and 8 correspond, generally, to that of FIG. 4, however, they depict the travel of the envelope between the first roller and its companion plate;

FIGS. 9 and 10, similar to FIGS. 4 through 6, show a document, which has displaced the operating sensor of the second switch, being propelled between the second roller and its companion plate, and finally, entering the envelope;

FIG. 11 illustrates the initial entry of a document into the mouth of an envelope held between side-mounted pins;

FIGS. 12 through 16 depict an alternative embodiment of the novel envelope stuffer which employs active guides in lieu of the fixed pins;

FIG. 12 corresponds, generally, to FIG. 2 showing, however, the spring-loaded channel guides;

FIG. 13, in greatly enlarged detail, shows a document addressing the envelope and closing upon the guides;

FIG. 14 shows the guides turned into the mouth of the envelope by the document;

FIG. 15 depicts a fragmentary portion of the envelope, a portion of an envelope-entering document and one of the guides; and FIG. 16 is a discontinuous, plan view of the document-turned guides within side portions of the envelope and the entry of the document into the envelope.

Figure 1:
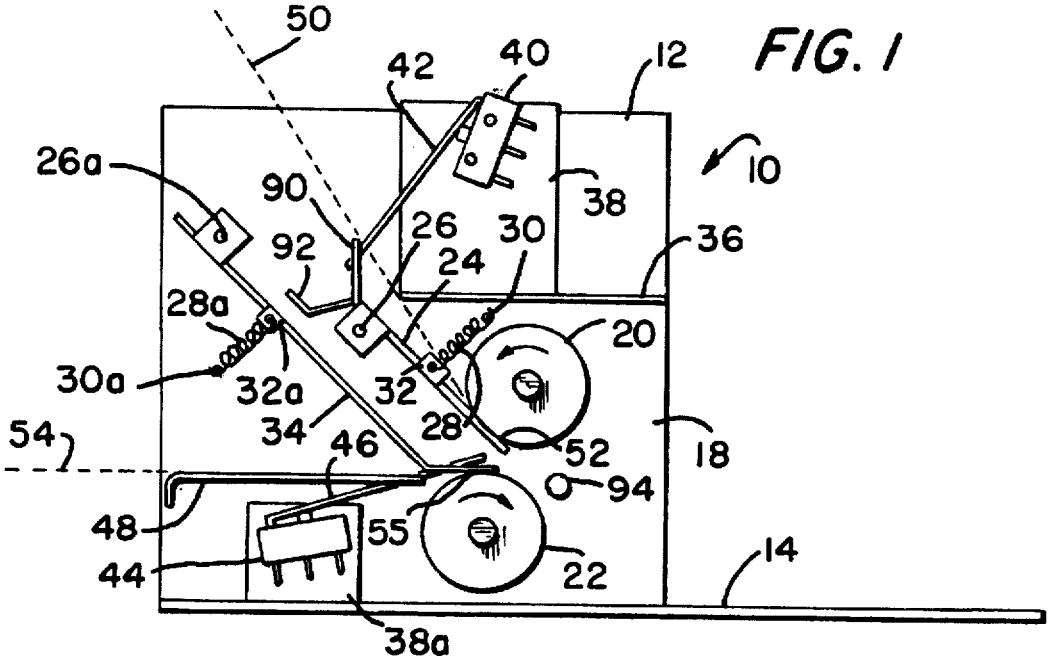
FIG. 1 is a side elevational view of the novel envelope stuffer, according to an embodiment thereof.

With particular reference to FIGS. 1 and 2, it can be seen that the inventive envelope stuffer 10, comprises a framework 12 which has a horizontal platform 14 and a pair of uprights 16 and 18. A pair of rollers, a first roller 20, and a second roller 22, are journalled in the uprights. Roller 20 has a companion plate 24 which is pivotable mounted, at opposite ends thereof, to the uprights, via holed pivot tabs 26 (only one of which is visible). In addition, the companion plate 24 is biasingly held in fast engagement with the first roller 20 by paired tension springs 28 (only one of which is visible) which are held, at one end to the uprights, by fasteners 30, and attached to the plate 24 by tabs 32. Similarly, roller 22 has a companion plate 34 which is biasingly held fast thereagainst by another pair of tension springs 28*a* which are held to the uprights by fasteners 30*a* and joined to tabs 32*a* of the plate 34. Again, only one of the springs 28*a* is visible. Plate 34 is also pivotably mounted to the uprights 16 and 18 via hold pivot tabs 26*a* at opposite ends thereof.

A support 36 overlies the first roller 20, extending between the uprights, and has a vertical panel 38 joined thereto. A first switch 40 is mounted to the panel, and has an operating limb 42 projecting therefrom and toward the companion plate 24. As shown in FIG. 2, panel 38 is positioned midway along the framework 12. A second switch 44 is mounted to another panel 38*a* which is vertically attached to the platform 14, and again, switch 44 is positioned midway along the framework 12. Switch 44 also has an operating limb 46 projecting therefrom and toward the companion plate 34. A horizontally disposed support 48, fixed at opposite ends thereof to the uprights 16 and 18, underlies the plate 34 and has an inner edge termination which is in proximity to the second roller 22.

Figure 3:
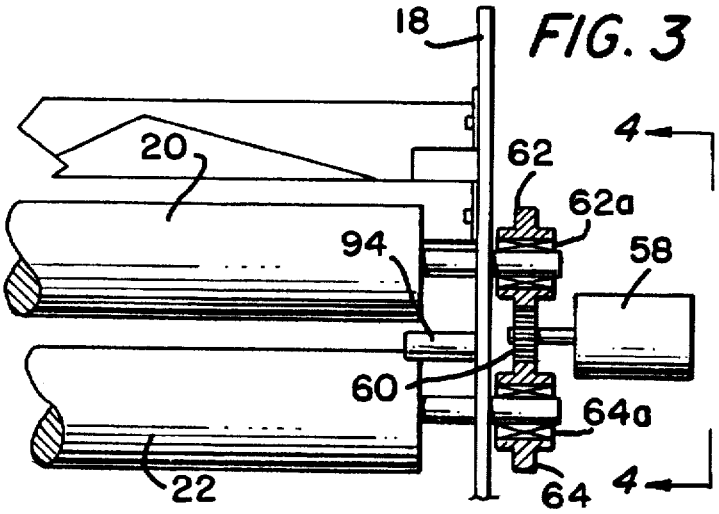
FIG. 3 is a fragmentary depiction of the novel envelope stuffer, showing the drive gearing for the rollers, the same being and elevational view similar to that of FIG. 2.

The bearing surface of plate 24 and the entry to roller 20 cooperate to define an envelope pathway 50 which ends, within the framework 12, in a nip 52. So also the bearing surface of support 48 and the entry to roller 22 cooperate to define a document pathway 54 which ends, within the framework 12, in a nip 55. Powered drive means 56, as can be seen in FIG. 2, is coupled to the rollers 20 and 22 to cause the rotation thereof. The drive means comprises a bi-directional motor 58, which has a drive gear 60 drivenly joined thereto, and each of the rollers 20 and 22 has a driven gear 62 and 64, respectively, joined thereto. Gear 62 is coupled to roller 20 by a clutch 62a which renders the gear 62 freely rotatable, relative to roller 20, when it is rotated in a clockwise direction (with reference to FIG. 1) and causes the gear 62 to drive the roller 20 in rotation, when the gear 62 is rotated in a counterclockwise direction. Conversely, gear 64 is coupled to roller 22 by a clutch 64a which renders the gear 64 freely rotatable, relative to roller 22, when it is rotated in a counterclockwise direction (with reference to FIG. 1), and causes the gear 64 to drive the roller 22 in rotation, when the gear 64 is rotated in a clockwise direction. FIGS. 3 and 4 depict the gear-ends of the rollers 20 and 22, the gearing and clutches, in a fragmentary depiction of the envelope stuffer, with the roller gears and clutches in cross-section, and an end view of the gearing train.

FIG. 5 depicts the powering arrangement for the motor 58, and its association with the switches 40 and 44. A power pack 66, which in this embodiment comprises a plug-in transformer for supplying step-down voltage, has a lead 68 which is engageable with a connector 70. A line 72 from the connector is connected to ground, whereas a line 74 from the connector is the power line. Line 74 is connected to terminals 76 and 78 of switches 40 and 44, respectively. Terminals 80 and 82 of the switches are connected to ground. However, if limb 42 and switch 40 is displaced, it causes switch arm 84 to close onto terminal 76, and supply power to the motor 58. The motor 58, then, will rotate in a clockwise direction, rotating gear 62 with which it is in mesh, in a counterclockwise direction. Consequently, roller 20 also rotates in counterclockwise direction. Gear 64 is also in mesh with the motor gear 60, but as it is rotated counterclockwise, it will not rotate roller 22. If limb 46 of switch 44 is displaced, it causes switch arm 86 to close onto terminal 73 and supply power to the motor 58. The motor 58, then, will rotate in a counterclockwise direction, rotating gear 64 with which it is in mesh, in a clockwise direction. Consequently, roller 22 also rotates in a clockwise direction. Gear 62 being rotated in the clockwise direction will be unable to rotate roller 20. Limbs 42 and 46 of the switches 42 and 44 are biased to return to their inactive dispositions when whatever caused their displacement has moved out of contact. In these circumstances, the switch arms 84 and 86 return to contacting engagement with the terminals 80 and 82, and the motor 58 is halted.

Upon an envelope 88 (FIG. 7) being moved along the pathway 50, with its closed bottom directed toward the nip 52, and its flap confrontingly facing the plate 24, it displaces the limb 42, because the limb 42 is in traverse of the pathway 50. As the closed bottom of the envelope 88 enters the nip 52, it is propelled between the roller 20 and the plate 24 due to the powered rotation of the motor 58, gear 60, and gear 62. Plate 24 has outwardly reaching webs 90 and 92 and, as the envelope flap engages the webs 90 and 92, it is turned up and outwardly, as depicted in FIG. 8. At opposite sides of the framework 12 are inwardly projecting pins 94, the same best seen in FIG. 2. With travel of the envelope 88, and as shown in FIGS. 7 and 8, it moves beneath the pins 94. Subsequently, envelope 88 will have travelled beyond the limb 42; the latter will return to its quiescent or inactive disposition to bring the motor to a halt, as well as to stop rotation of roller 20. A cooperation of the pins 94, and the halted roller 20 and plate 24, hold the envelope 88 securely in place. In that plate 24 is biasingly pressed against the halted roller 20, the two act like a brake. As depicted in FIG. 9, the envelope 88 is held fast, and the pins 94 are astride the spine of the flap. The flap itself is now immovable, and the throat of the envelope is exposed, and lying open, ready to receive a document, paper or such.

As noted in the foregoing, the plate 24, the halted roller 20, and the pins 94 hold the envelope in place, with the pins 94 being astride the spine of the flap. Now, it is predetermined for documents to have a width, upon entry into the stuffer 10, less than the width obtaining between the pins 94. The open throat of the envelope, held at each side by the pins 94, has the center thereof suspended in space. Upon the leading edge of a document addressing the envelope 88, it engages the uppermost portion of the mouth of the envelope 88, as shown in FIG. 11. As a consequence of this, the uppermost portion of the envelope assumes a concave configuration, and the mouth of the envelope 88 defines a shallow ellipse.

Upon a document, a paper, or such, properly folded for whole containment in the envelope 88, being moved along the pathway 54 towards the nip 55, it causes the limb 46 (which is in traverse of the pathway) to be displaced. Then, as explained in the foregoing, the motor 58 causes the roller 22 to rotate in a clockwise direction. The document enters the nip 55, and slides under the envelope flap and moves into the envelope 88. With movement of the document beyond the limb 46, the latter returns to its quiescent or inactive disposition, and the motor 58 and roller 22 halt rotation. FIGS. 9 and 10 depict the travel of the document along the pathway 54 and into the envelope. One has only to withdraw the envelope 88 with its enclosed document, manually. However, it is self-evident that, in another configuration, the envelope stuffer could well have another switch and roller arrangement for powered out-feeding of the document-confining envelope 88.

In an alternative embodiment of the invention, the fixed pins 94 are dispensed with, and active guides are employed. In lieu of the fixed pins 94, the alternative embodiment, as shown in FIGS. 12 through 16, has spring-biased, channel guides 96. The guides 96 are short channel members, having narrowed, mutually facing noses 98. Coil springs 100 are engaged with the guides 96, and uprights 16 and 18, to keep the guides normally mutually facing (as shown in FIGS. 12 and 13). Now, with the flap of the envelope 88 held between the roller 20 and the companion plate 24, the envelope 88 is disposed for receipt of a document. FIG. 13 shows a document advancing upon the envelope 88, and closing upon the guides 96. In FIG. 14 it can be seen that the document has engaged the guides, rotated the guides 96 against the bias of the springs 100, and has moved the narrowed noses 98 of the guides 96 into the sides of the mouth of the envelope 88. FIG. 15 shows a fragmentary portion of the envelope 88, one of the guides 96 and the envelope-entering document. FIG. 16 is a discontinuous, plan view of a document entering the envelope 88, and shows the guides 96 within the sides of the mouth of the envelope 88.

Upon withdrawal of the envelope 88, with the inserted document, the guides 96 respond to the spring biasing and, again, assume the positioning thereof as shown in FIGS. 12 and 13.

While I have described my invention in connection with specific embodiments thereof, it is to be clearly understood that this is done only byway of example, and not as a limitation to the scope of my invention, as set forth in the objects thereof, and in the appended claims.

I claim:

1. An envelope stuffer, comprising:

a framework;

said framework having a horizontal platform, and a pair of uprights coupled to, and adjacent ends of said platform;

a pair of rollers, journalled in said uprights, in parallel, and spaced apart from each other;

a pair of plates pivotably mounted to said uprights; one of said plates having a planar side which parallels one of said rollers and comprising a companion plate for said one roller;

the other of said plates also having a planar side which parallels the other of said rollers and comprising a companion plate for said other roller;

biasing means, coupled to said uprights and to said plates, for urging said side of said one plate into fast engagement with said one roller, and for urging said side of said other plate into fast engagement with said other roller;

powered drive means, coupled to said rollers, operative for rotating said rollers;

first switching means, coupled to said drive means, having an operating sensor disposed for contacting engagement thereof by an edge of an envelope inserted between one of said rollers and its companion plate, for (a) causing said drive means to operate, to rotate said one roller, and to propel such envelope between said one roller and its companion plate, and (b) halting operation of said drive means upon such envelope having moved beyond sensor engagement to a given positioning in said framework;

projections, extending inwardly of said framework, cooperative with said one roller and its companion plate, for holding the flap of such envelope, upon such envelope having moved to said given positioning; and second switching means, also coupled to said drive means, having an operating sensor disposed for contacting engagement thereof by an edge of a document inserted between the other of said rollers and its companion plate, for (a) causing said drive means to operate, to rotate said other roller, and to propel such document (1) between said other roller and its companion plate, (2) beneath and slidably along an underside of the envelope flap, and (3) into such envelope, and (b) halting operation of said drive means upon such document having moved beyond sensor engagement.

2. An envelope stuffer, according to claim 1, wherein:

said powered drive means comprises a bi-directional motor, and a gear train drivenly coupled to said motor;

said gear train comprises a first gear coupled to said one roller, and a second gear coupled to said other roller;

said first gear is freely rotatable, relative to said one roller, upon rotation thereof in one direction; and said second gear is freely rotatable, relative to said other roller, upon rotation thereof in a direction which is opposite said one direction.

3. An envelope stuffer, according to claim 2, wherein:

said first gear is coupled to said one roller by means for causing said one roller to rotate in said opposite direction, upon said first gear rotating in said opposite direction; and said second gear is coupled to said other roller by means for causing said other roller to rotate in said one direction, upon said second gear rotating in said one direction.

4. An envelope stuffer, according to claim 3, wherein:

said first switching means comprises means for causing said motor to rotate in a given direction to cause said first gear to rotate in said opposite direction; and said second switching means comprises means for causing said motor to rotate in an alternate direction to cause said second gear to rotate in said one direction.

5. An envelope stuffer, according to claim 1, wherein:

said one roller and its companion plate cooperatively define a first longitudinal pathway extending lengthwise of said framework;

said operating sensor of said first switching means comprises an extended, actuating limb; and said limb is in traverse of said pathway.

6. An envelope stuffer, according to claim 1, wherein:

said one roller and its companion plate cooperatively define a second longitudinal pathway extending lengthwise of said framework;

said operating sensor of said second switching means comprises an extended, actuating limb; and said limb is in traverse of said second pathway.

7. An envelope stuffer, according to claim 1, wherein:

said projections comprises pins mounted to said uprights, and extending inwardly of the framework.

8. An envelope stuffer, according to claim 1, wherein:

said projections comprise spring-biased guides;

said guides are of channeled configuration, and have narrowed noses; and further including coil springs engaged with said guides and said uprights.

9. An envelope stuffer, according to claim 8, wherein:

said guides are rotatable relative to said uprights.

10. An envelope stuffer, according to claim 1, wherein:

one of said companion plates has means operative, upon movement of an envelope into said framework, for engaging said flap of said envelope, raising said flap, and rotating said flap outwardly relative to said envelope.

11. An envelope stuffer, according to claim 10, wherein:

said flap-engaging means comprises webs, outwardly reaching from said one companion plate.

* * * * *